United States Patent [19]

Dear et al.

[11] 4,449,481

[45] May 22, 1984

[54] CALF CART

[76] Inventors: Buck Dear; Tim Spencer, both of 2312 Ninth Ave. S., Great Falls, Mont. 59405

[21] Appl. No.: 411,026

[22] Filed: Aug. 24, 1982

[51] Int. Cl.[3] ..... A61D 3/00

[52] U.S. Cl. ..... 119/96; 119/102

[58] Field of Search ..... 119/96, 100, 102, 103; 272/70.3; 280/722

[56] References Cited

U.S. PATENT DOCUMENTS

| | | | |
|---|---|---|---|
| 1,277,052 | 8/1918 | Dunn | 119/102 |
| 2,224,246 | 12/1940 | Ames | 272/70.3 |
| 2,426,513 | 8/1947 | Linn | 280/722 |
| 2,652,097 | 9/1953 | Warren | 272/70.3 |
| 3,406,661 | 10/1968 | Parkes | 119/102 |
| 3,621,819 | 11/1971 | Hooper | 119/102 |

OTHER PUBLICATIONS

Carter et al., "A Minimal Injury Restraining Device for Swine" from Laboratory Animal Science, vol. 30, Feb-.-Dec. 1980.

*Primary Examiner*—Robert Peshock
*Assistant Examiner*—Kris R. Schulze
*Attorney, Agent, or Firm*—Armstrong, Nikaido, Marmelstein & Kubovcik

[57] ABSTRACT

A cart for transporting a new-born calf permitting its mother to closely follow it in a natural manner which includes a frame having a front ground-engaging portion, rear ground-engaging portions and at least one central longitudinal member interconnecting the same, and a pair of horse-shoe shaped cradle arms having cradle straps thereon for cradling the new-born calf in an upright position with its legs dangling and unable to touch ground.

10 Claims, 7 Drawing Figures

CALF CART

BACKGROUND OF THE INVENTION

1. Field of the Invention

The present invention relates to a cart for transporting a new-born animal and, more specifically, relates to a cart for transporting a new-born calf permitting its mother to closely follow.

2. Description of the Prior Art

At present, it is very difficult to move a new-born calf until it is two or three days old and can walk on its own. A younger calf must be picked up and carried by some other means. It is most important that the calves be moved from the birthing area. Pregnant cows are often collected in a herd where they can be watched and assisted if they have difficulties in giving birth. The drop-area of calving shed is impossible to keep clean and dry and thus there is a significant hazard of disease. The probability of a calf contracting such disease increases significantly the longer that it is left in a confined, unhealthy environment.

However, it is imperative that the calf and its mother be kept together or difficulties may arise. If separated, the mother will instinctively return to the spot where birth was given. If the pair are apart for as long as 24 to 48 hours, the mother can forget which calf is hers and will reject it and refuse to nurse.

Certain prior art methods of transport are known, such as placing the calf in the back of a pick-up truck or tieing the calf down on a sled made of an old automobile hood and dragging it along. However, the mother will not follow the calf unless the movement process appears natural to her. She desires to remain close to the calf and will constantly sniff and smell the calf, assuring herself that it is her own.

Other prior art means for transporting animals are known. However, these do not appear to solve the problem of how to transport a new-born calf, giving the appearance to the calf's mother that the calf is walking away.

OBJECTS AND SUMMARY OF THE INVENTION

It is an object of the present invention to provide an apparatus for transporting a new-born calf, permitting its mother to closely follow.

It is a further object of the present invention to provide a cart for transporting a new-born calf which gives the appearance that the calf is simply and easily walking.

It is yet a further object of the present invention to provide a cart for transporting a new-born calf safely and easily.

It is still another object of the present invention to provide a cart for transporting a new-born calf which is simple to manufacture and easy to maintain.

These and other objects, which will be readily apparent to a person of ordinary skill in the art, are obtained in a cart for transporting a new-born calf permitting its mother to closely follow which comprises a frame and means on the frame for cradling the new-born calf in an upright position with its legs dangling and unable to touch ground. The frame can include front ground-engaging portion, rear ground-engaging portions and at least one central longitudinal member interconnecting the front and rear portions. The means for cradling the new-born calf are on the longitudinal member.

The cart can further comprise a means on the longitudinal member for preventing the calf from sliding backwardly in the cradle means. The means for preventing can comprise a buttocks bar perpendicularly affixed to the longitudinal member rearwardly of the cradle means.

The cradle means can comprise a pair of U-shaped cradle members, each having a center portion and two upright portions, with the center portion being affixed to the longitudinal member and two flexible cradle straps. Each cradle strap has opposite ends. The opposite ends of each strap are attached to the two upright portions of one of the cradle memers. The cradle straps can be made of a synthetic resin such as Nylon.

The front ground-engaging portion of the frame can comprise a semi-circular skid or a rotatably mounted wheel.

The rear ground-engaging portions can each comprise a skid or a rotatably mounted wheel. Each rear ground-engaging portion can further comprise a bearing pipe affixed to the frame perpendicularly of the longitudinal member, a crank-shaped bar axle having two parallel arms and a center section, with one of the parallel arms being pivotally mounted in the bearing pipe with the other parallel arm rotatably mounting the wheel, and a coil spring having opposite ends with one end being an extending spring arm. The coil spring surrounds the bearing pipe with one end being attached to the bearing pipe and the spring arm engaging the center section of the crank-shaped bar axle. This construction is particularly preferred because the frame is easy to pull and gives way easily to ground should the mother cow step on one of the frame members while following the calf being transported.

The frame can further include a lateral frame member interposed between the rear ground-engaging portions, a vertical post extending upwardly from the lateral frame member, an upper main member comprising the central longitudinal member, the main member being connected to the vertical post perpendicularly of the lateral frame member, a forward extension interconnecting the main member to the front ground-engaging portion, a pair of vertical supports extending between the lateral frame member and the main member, and a pair of lower longitudinal members extending between the lateral frame member and the front ground-engaging portion.

Having the front ground-engaging portion be a semi-circular skid is most preferred because a tether rope can be attached thereto for pulling the cart from a distance of about twenty-five feet. With the skid slightly dragging on the ground, the cart is much more controllable than if a rotatable wheel were present in place of the skid.

BRIEF DESCRIPTION OF THE DRAWINGS

The above and other objects and the attendant advantages of the present invention will become readily apparent by reference to the following detailed description when considered in conjunction with the accompanying drawings wherein.

DETAILED DESCRIPTION OF PREFERRED EMBODIMENTS

Figure 1:
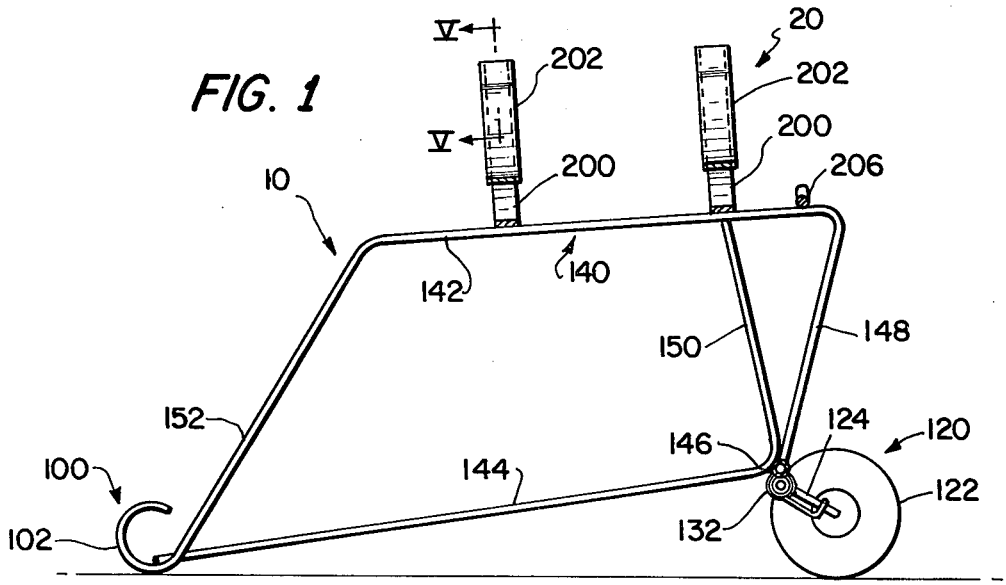
FIG. 1 shows a side, partial cross-sectional view of a first embodiment of the present invention.
Figure 2:
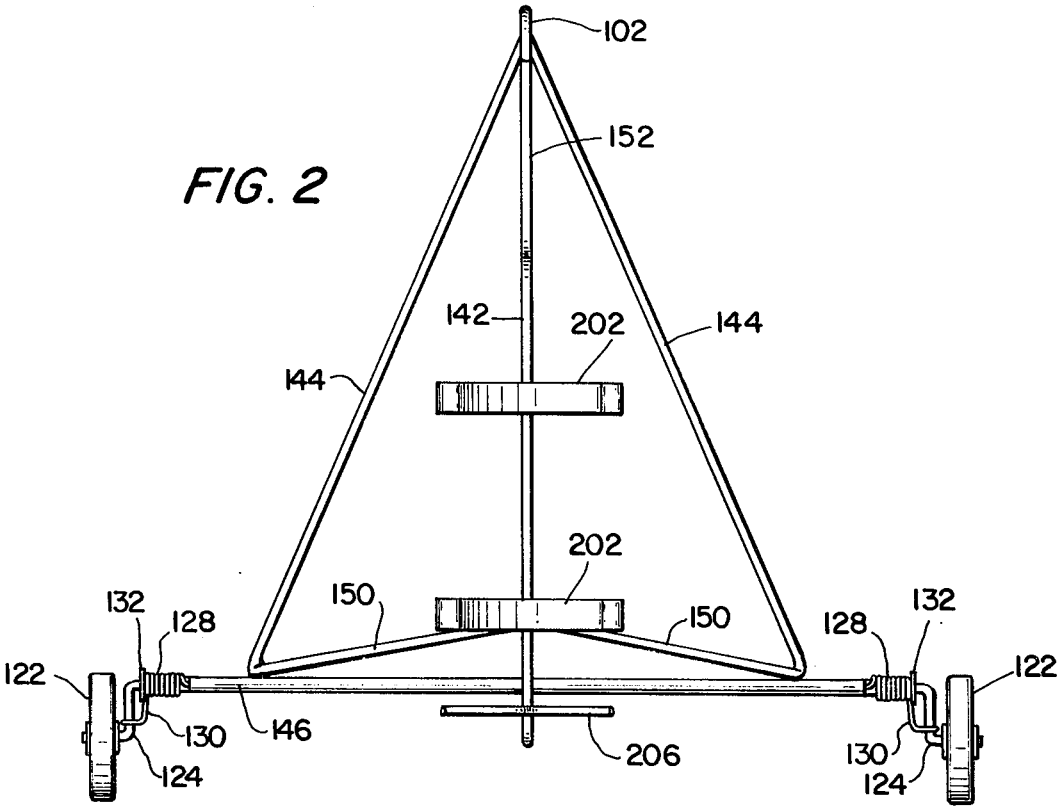
FIG. 2 shows a top view of the first embodiment.
Figure 3:
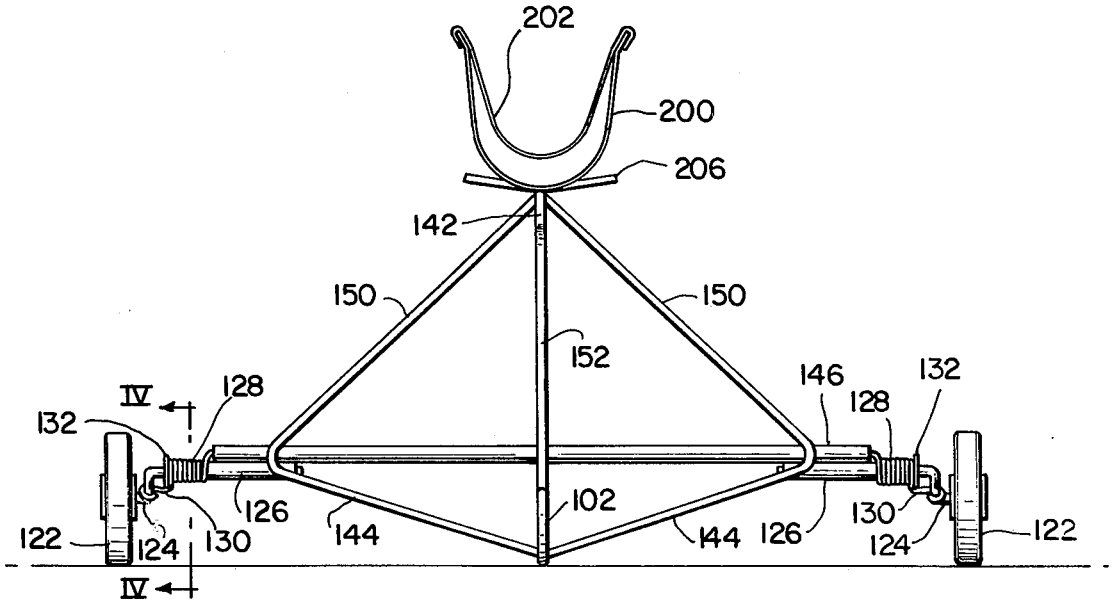
FIG. 3 shows a front view of the first embodiment.
Figure 4:
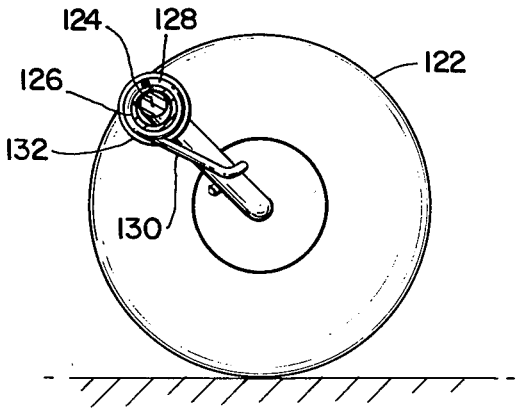
FIG. 4 shows a cross-sectional view along lines IV—IV of FIG. 3.

As can be seen in FIGS. 1-3, the calf cart of the present invention generally comprises a frame 10 having a front ground-engaging portion 100, rear ground-engaging portions 120 and a central longitudinal member 140. Means 20 are presented on the longitudinal member 140 for cradling the new-born calf in an upright position with its legs dangling and unable to touch the ground. The cradle means 20 provides the appearance that the calf is walking, while actually the calf's legs are just slightly above the ground. In this manner, the mother cow will readily follow the calf as it is removed from the birthing area.

In the most preferred first embodiment, the front ground-engaging portion 100 comprises a semi-circular skid 102. The rear ground-engaging portions 120 in the first embodiment comprises a wheel 122 mounted on a crank shaped-bar axle 124, which is a rod leaving two 90° bends. This forms two parallel arms and a center section. One of the parallel arms is pivotally mounted in a bearing pipe 126. The bearing pipe 126 may contain bushings (not shown). The parallel arm fitted in the bearing pipe 126 can be drilled to accommodate a roll pin. The opposite parallel arm of the bar axle 124 is fitted to the hub of the wheel 122. A coil spring 128 is wrapped around the bearing pipe 126 and attached thereto. The coil spring 128 has a spring arm 130 which-hooks the center section of the bar axle 124. A spring retainer 132 is provided on the end of the bearing pipe 126 to prevent the coil spring 128 from sliding off the end thereof. This coil spring 128 is provided to prevent the bar axle 124 from being bent by allowing it to depress to the ground when stepped on by a mature cow.

The central longitudinal member 140 can be a main upper member 142 of an essentially triangular frame. The frame further consists of a lateral frame member 146 to which the rear ground-engaging portions 120 are attached. The main upper member 142 is perpendicular to the lateral frame member 146. A vertical post 148 rises from the center of the lateral frame member 146 to support the end of the main upper member 142. A pair of triangularly positioned vertical supports 150 are provided to assist in holding the main upper member 142 from bending. Lower longitudinal members 144 are provided between the lateral frame member 146 and the front ground-engaging portion 100 to provide lateral stiffening of the frame. A forward extension 152 extends from the front end of the main upper member 142 to the front ground-engaging portion 100. As previously noted, the semi-circular skid 102 is the preferred front ground-engaging portion 100. A tether rope may be attached to the semi-circular skid 102 for pulling the cart. The skid 102 can also function as a brake when the cart is being pulled downhill. This open frame provides structure such that when the calf is in the cart, which is towed with 20 to 25 feet of rope, it almost appears that the calf is running. The mother follows the calf quite willingly, and she has unobstructed access to smell and keep close to the calf.

Figure 5:
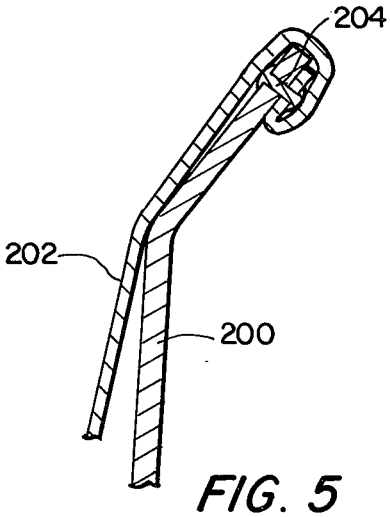
FIG. 5 shows a partial cross-sectional view taken along lines V—V of FIG. 1.

The means 20 on the longitudinal member 140 for cradling the new-born calf in an upright position with its legs dangling and unable to touch the ground in the most preferred embodiment comprises cradle members 200, each formed in a U-shape, having a center portion and two upright portions. The center portion is affixed to the main upper member 142. A flexible cradle strap 202 having opposite ends is attached at each of the opposite ends to the two upright portions of the cradle member 200. As shown in FIG. 5, the method of attaching can comprise placing the cradle strap 202 against a lower portion of an extension of the cradle member 200, riveting the cradle strap 202 to the cradle member 200 by a rivet 204 and then looping the cradle strap back and over the upper portion of the upright of the cradle member 200. The simplest means of making the cradle member is to simply bend two pieces of hot rolled flat steel into a horseshoe shape and weld them onto the horizontal upper main bar at a distance of fourteen inches apart. The cradle strap 202 is preferably two inches wide.

The means for cradling can further comprise a means on the longitudinal member for preventing the calf from sliding backwardly in the cradle means. The simplest form of this means for preventing is a buttocks bar 206 perpendicularly affixed to the longitudinal member rearwardly of the cradle means. This keeps the calf from escaping or sliding backwards. The buttocks bar is generally welded five inches behind the rearmost cradle member 202.

Figure 6:
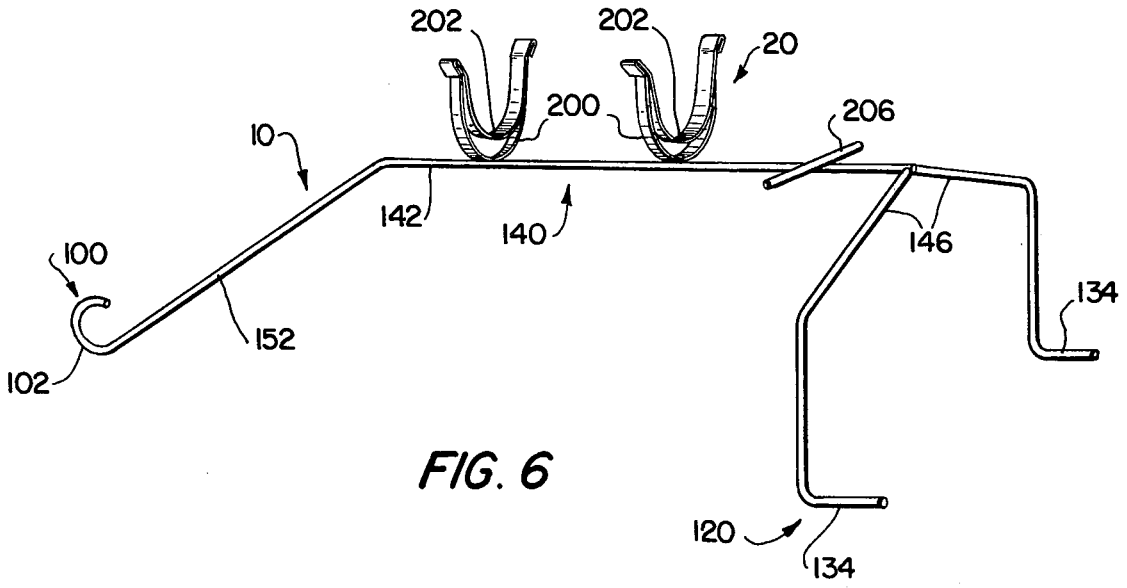
FIG. 6 shows a perspective view of a second embodiment of the present invention.

FIG. 6 shows an alternative embodiment wherein the frame consists of an upper main member 142 having a forward extension 152 attached to a front ground-engaging portion 100 in the form of a semi-circular skid 102. The remainder of the frame is a pair of lateral frame members 146 extending from the opposite end of the upper main member which have downwardly extending portions which are curved to form the rear ground-engaging portions in the form of skids 134. A cradle means 20 and a butt bar 206 are affixed to the upper main member 142.

Figure 7:
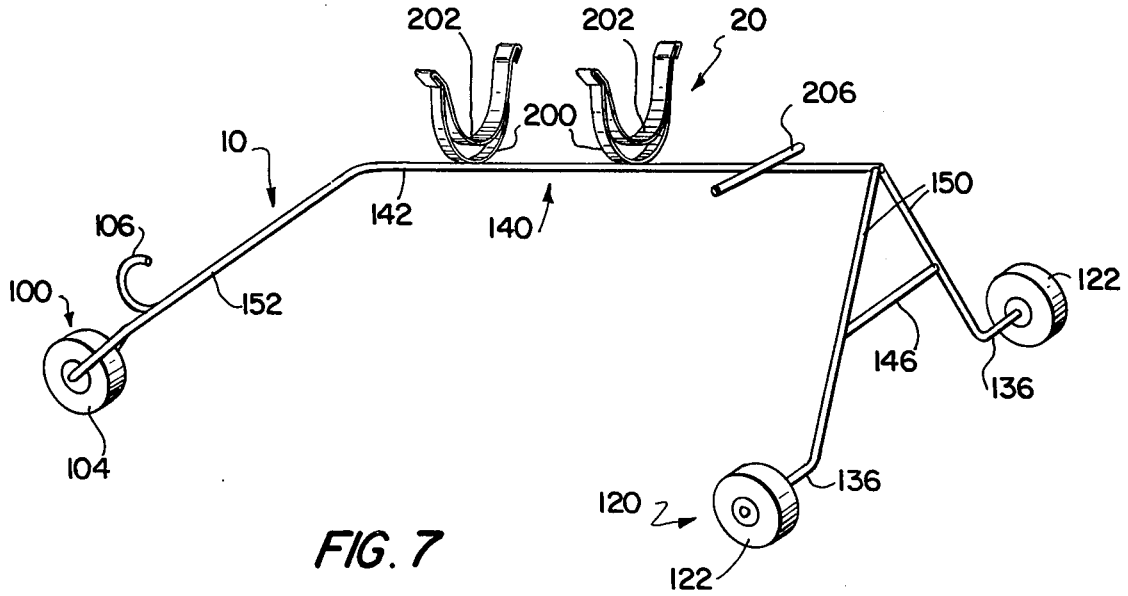
FIG. 7 shows a perpective view of a third embodiment of the present invention.

A third embodiment is shown in FIG. 7 having a single central upper main bar 142 with a forward extension 152 having, as the front ground-engaging portion 100, a wheel 104 rotatably mounted thereon. A hook 106 is provided for attaching a tether rope. On the rearward end of the upper main member 142, a pair of vertical supports 150 are provided having a lateral frame member 146 therebetween. This forms a A-shaped rearward frame section. Axles 136 are attached to the lower ends of the vertical supports 152. The axles 136 and wheels 122 form the rear ground-engaging portions 120. Cradle means 20, together with a butt bar 206, are provided on the upper main member 142.

As is readily apparent from the above description, the calf cart of the present invention is simple to manufacture, easy to maintain and simple to use. A rancher who desires to move a new-born calf away from the birthing area can simply pick the calf up and place it into the cradle means 20. Towing the calf cart with a tether rope of 20 to 25 feet gives the appearance that the calf is running on its own while actually the calf's legs are just slightly above the ground. The mother cow naturally follows the calf, which the cow believes is walking. In this manner, the new-born calves can easily be removed from the birthing area, thus minimizing the chances of disease.

It is readily apparent that the above-described calf cart meets all of the objects mentioned above and also has the advantage of wide commercial utility. It should be understood that the specific forms of the invention hereinabove described are intended to be representative only, as certain modifications within the scope of these teachings will be apparent to those skilled in the art.

Accordingly, reference should be made to the following claims in determining the full scope of the invention.

What is claimed is:

1. A cart for transporting a new-born calf permitting its mother to closely follow comprising:

a frame, said frame including a front ground-engaging portion, rear ground-engaging portions, at least one central longitudinal member interconnecting said front and rear portions, a lateral frame member interposed between said rear ground-engaging portions, a verticle post extending upwardly from said lateral frame member, an upper main member comprising said central longitudinal member, said main member being connected to said vertical post perpendicularly of said lateral frame member, a forward extension interconnecting said main member to said front ground-engaging portion, a pair of vertical supports extending between said lateral frame member and said main member, and apair of lower longitudinal members extending between said lateral frame member and said front ground-engaging portion and means supported on and positioned above said central longitudinal member for cradling the newborn calf in an upright position with its legs dangling and unable to touch ground with a minimum amount of structure being visible.

2. The cart as claimed in claim 1 further comprising means on said longitudinal member for preventing the calf from sliding backwardly in the cradle means.

3. The cart as claimed in claim 2 wherein the means for preventing comprises a buttocks bar perpendicularly affixed to said longitudinal member rearwardly of said cradle means.

4. The cart as claimed in any one of claims 1, 2 or 3 wherein said cardle means comprises a pair of U-shaped cradle members, each having a center portion and two upright portions, said center portion being affixed to said longitudinal member, and two flexible cradle straps, each having opposite ends, the opposite ends of one cradle strap being attached to the two upright portions of one cradle member.

5. The cart of claim 4 wherein said cradle straps are made of a synthetic resin.

6. The cart as claimed in claim 1 wherein said front ground-engaging portion comprises a semi-circular skid.

7. The cart as claimed in claim 1 wherein said front ground-engaging portion comprises a rotatably mounted wheel.

8. The cart as claimed in claim 1 wherein said rear ground-engaging portions each comprise a skid.

9. The cart as claimed in claim 1 wherein said rear ground-engaging portions each comprise a rotatably mounted wheel.

10. The cart as claimed in claim 9 wherein each rear ground-engaging portion further comprises a bearing pipe affixed to said frame perpendicularly of said longitudinal member, a crank shaped bar axle having two parallel arms and a center section, one of the parallel arms being pivotally mounted in said bearing pipe with the other parallel arm rotatably mounting said wheel, and a coil spring having opposite ends with one end being an extending spring arm with a hook thereon, said coil spring surrounding said bearing pipe with the other end being attached to said bearing pipe, said spring arm hook engaging said center section of said crank shaped bar axle.

* * * * *